US012559822B2

(12) United States Patent
Jørgensen et al.

(10) Patent No.: US 12,559,822 B2
(45) Date of Patent: Feb. 24, 2026

(54) METHOD FOR SELECTIVE SEPARATION OF THORIUM AND CERIUM FROM A SOLID CONCENTRATE COMPRISING SAME AND ONE OR MORE FURTHER RARE EARTH METALS AND ACIDIC RARE EARTH SOLUTION THEREOF

(71) Applicants: YARA INTERNATIONAL ASA, Oslo (NO); REETEC AS, Oslo (NO)

(72) Inventors: Tom R. Jørgensen, Porsgrunn (NO); Fredrik Rodahl, Sandefjord (NO); Sigve Sporstøl, Hagan (NO)

(73) Assignees: YARA INTERNATIONAL ASA, Oslo (NO); REETEC AS, Oslo (NO)

( * ) Notice: Subject to any disclaimer, the term of this patent is extended or adjusted under 35 U.S.C. 154(b) by 778 days.

(21) Appl. No.: 17/908,942

(22) PCT Filed: Mar. 5, 2021

(86) PCT No.: PCT/EP2021/055557
§ 371 (c)(1),
(2) Date: Sep. 2, 2022

(87) PCT Pub. No.: WO2021/176037
PCT Pub. Date: Sep. 10, 2021

(65) Prior Publication Data

US 2023/0089345 A1 Mar. 23, 2023

(30) Foreign Application Priority Data

Mar. 6, 2020 (EP) ..... 20161399

(51) Int. Cl.
*C22B 60/02* (2006.01)
*C22B 3/06* (2006.01)
*C22B 59/00* (2006.01)

(52) U.S. Cl.
CPC ..... *C22B 60/0291* (2013.01); *C22B 3/065* (2013.01); *C22B 59/00* (2013.01)

(58) Field of Classification Search
None
See application file for complete search history.

(56) References Cited

U.S. PATENT DOCUMENTS

| | | | |
|---|---|---|---|
| 3,111,375 A | 11/1963 | Gottdenker et al. | |
| 3,594,117 A | 7/1971 | Vincent | |
| 2017/0260606 A1* | 9/2017 | Kasaini | C22B 3/20 |

FOREIGN PATENT DOCUMENTS

| | | |
|---|---|---|
| DE | 65075 | 1/1969 |
| RU | 2573905 C | 1/2016 |
| WO | 2016058007 A2 | 4/2016 |

OTHER PUBLICATIONS

Zhu, Z. et.al., "Separation of uranium and thorium from rare earths for rare earth production—A review", 2015, Minerals Engineering, vol. 77, pp. 185-196.
Abreu, et al., Purification of rare earch elements from monazite sulphuric acid leach liquor and the production of high-purity ceric oxide; Minerals Engineering, 23 (2010), pp. 536-540.
McNeice, et al., Oxidative precipitation of cerium in acidic chloride solutions: part I—Fundamentals and thermodynamics, Hydrometallurgy 184 (2019) pp. 140-150.
Roux, E.H. , et al., Phosphate in South Africa, Journal of The South African Institute of Mining and Metallury, vol. 89, No. 5, May 1989, pp. 129-139.
Office Action received for African Application No. AP/P/2022/014293, mailed on Apr. 4, 2025, 6 pages of English translation only.
Zhao et al., "Extraction and separation of cerium (IV) from nitric acid solution containing thorium (IV) ad rare earths (III) by DEHEHP", Journal of Alloy and Compounds, vol. 372, Jul. 2004, pp. 438-447.
International Search Report and Written Opinion issued in App. No. PCT/EP2021/055557, mailing date Jun. 14, 2021, 15 pages.
Abreu, Renata D., et al: "Purification of rare earth elements from monazite sulphuric acid leach liquor and the production of high-purity ceric oxide", Minerals Engineering, vol. 23, No. 6, May 1, 2010 (May 1, 2010), pp. 536-540, XP055085814, ISSN: 0892-6875, DOI: 10.1016/j.mineng.2010.03.010.
McNeice, James, et al: "Oxidative precipitation of cerium in acidic chloride solutions: part I—Fundamentals and thermodynamics", Hydrometallurgy, vol. 184, Dec. 21, 2018 (Dec. 21, 2018), pp. 140-150, XP085613642, ISSN: 0304-386X, DOI: 10.1016/J.HYDROMET.2018.12.018.

* cited by examiner

*Primary Examiner* — Keith D. Hendricks
*Assistant Examiner* — Nikolas Takuya Pullen
(74) *Attorney, Agent, or Firm* — DILWORTH IP, LLC

(57) ABSTRACT

A method for separating thorium and cerium from a solid concentrate comprising compounds of thorium, cerium and further rare earth metals, comprising:

a) contacting the solid concentrate with an acid to achieve an acid composition with a pH of less than 0.5;
b) reacting the acid composition obtained in step a) with ozone or heating the acid composition at a temperature ranging from 110° C. to 130° C. for a time period ranging from 1 to 3 hours, thereby oxidizing the cerium ions in the acid composition to an oxidation state of +IV;
c) increasing, to at most 2, the pH of the composition obtained in step b), resulting in the precipitation of thorium and cerium compounds; and
d) separating the precipitated thorium and cerium compounds from the composition obtained in step c) to obtain an aqueous acidic rare earth solution depleted in thorium and cerium.

23 Claims, No Drawings

METHOD FOR SELECTIVE SEPARATION OF THORIUM AND CERIUM FROM A SOLID CONCENTRATE COMPRISING SAME AND ONE OR MORE FURTHER RARE EARTH METALS AND ACIDIC RARE EARTH SOLUTION THEREOF

FIELD OF THE INVENTION

The invention relates to the field of rare earth metals and, more specifically, to the selective separation of thorium and cerium from a solid concentrate comprising compounds of thorium, cerium and other rare earth metals.

BACKGROUND

The group of rare earth elements consists of seventeen chemical elements (cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb), and yttrium (Y)).

The rare earth elements are all metals, and the group is often referred to as the "rare earths" or "rare earth metals". These metals have many similar properties, which often causes them to be found together in geological deposits. When a rare earth metal is incorporated into a compound, it is referred to as a "rare earth compound". Rare earths are also referred to as "rare earth oxides" because many of them are typically commercialized as oxide compounds.

Rare earth metals and alloys that contain them are used in many devices that people use every day such as computer memories, DVDs, rechargeable batteries, cellular phones, catalytic converters, magnets, fluorescent lighting, and much more.

During the past twenty years, there has been a rise in demand for many items that require rare earth metals. Many rechargeable batteries are made with rare earth compounds. Demand for the batteries is being driven by demand for portable electronic devices such as cellular phones, readers, GPS-devices, portable computers, cameras, and electric and hybrid vehicles, the sale of which is driven by concerns for energy independency and climate change.

Rare earths are used as catalysts, phosphors, and polishing compounds, where they are used for air pollution control, illuminated screens on electronic devices, and the polishing of optical-quality glass. All of these products are expected to experience a steep rising demand.

The presence of cerium has been found to interfere with the recovery of other rare earths. Therefore, in order to maximize the recovery of the rare earths other than cerium, the separation of cerium is necessary.

In addition, as rare earth minerals mined are principally contained in ores and minerals that contain radioactive thorium, radioactive thorium is also often extracted along with rare earths metals. Considering the radioactivity issues with thorium (Zhu Z. et.al., "Separation of uranium and thorium from rare earths for rare earth production—A review", 2015, *Minerals Engineering*, Volume 77, p. 185-196), thorium should be removed as effectively as possible in order for a concentrate of rare earths to be handled safely.

Therefore, as thorium and rare earths, including cerium, are often extracted together from rare earth minerals mined, two problems are to be solved:

1. radioactive thorium should effectively be separated from the rare earths for the concentrate of rare earths to be handled safely, for example in further purification steps;
2. cerium should also be effectively separated from the other rare earths in order to maximize the recovery of the rare earths other than cerium;

These problems specifically arise in workup material of the nitrophosphate process (also known as the Odda process), which is a method for the industrial production of nitrogen fertilizers. The process involves acidifying phosphate rock with nitric acid to produce a mixture of phosphoric acid and calcium nitrate.

$$Ca_3(PO_4)_2+6\ HNO_3+12\ H_2O \rightarrow 2\ H_3PO_4+3\ Ca(NO_3)_2+12\ H_2O.$$

As a step in the process, a solid concentrate is produced comprising compounds of thorium, cerium and one or more further rare earth metals, obtainable by neutralizing to pH 1.8 an aqueous composition comprising from 6 to 21 weight % nitric acid, from 25 to 33 weight % phosphoric acid, from 3.5 to 5 weight % calcium, and amounts of compounds of thorium, cerium and one or more further rare earth metals, the weight % being relative to the total weight of the aqueous composition.

BACKGROUND PRIOR ART

RU2573905C (Laboratory of Innovative Technologies, 2014) discloses a method that can be applied for processing and deactivating a rare-earth concentrate (REC) which is extracted from apatite concentrate and for processing the products of the processing of the REC such as phosphogypsum and phosphoric acid. The rare-earth concentrate, containing uranium and thorium compounds, is dissolved in nitric acid with heating and agitation, resulting in the dissolution of any sludge. The solution then is diluted with water and cooled. After this, hydrogen peroxide is added, resulting in the reduction of from 98.0 to 99.5% of cerium (+4) to cerium (+3). Next, thorium is separated by co-precipitation with barium sulphate, through the addition of sulphates and soluble barium compounds, and neutralisation of the nitric acid solution to pH from 2.5 to 3.9, at from 35 to 45° C., for from 1.0 to 1.5 hours. The barium-thorium cake and the nitric acid solution are separated by filtration.

U.S. Pat. No. 3,111,375 (F. Gottdenker and P. Krumholz, 1961) discloses a process in which the trivalent rare earths are first separated from the cerium and the thorium. In a second step, the cerium is separated from the thorium. A mixture of the oxides of the rare earths and of thorium is obtained from an alkaline attack of monazite, and subsequent drying and heating in the presence of air to a temperature above 100° C., preferably between 130° C. and 140° C., thus transforming the cerium contained in the mixture into ceric oxide.

*Minerals Engineering* 23 (2010) 536-540 (Centro de Desenvolvimento da Technologia Nuclear, Belo Horizonte, Brazil) relates to the purification of rare earths elements from a monazite sulphuric acid liquor and to the production of high-purity ceric-oxide.

U.S. Pat. No. 3,594,117 (Sylvania Electric Products Inc., 1971) relates to a process for removing cerium and thorium from other rare earths metals at a pH from about 4 to 5 and using iodate ions.

*Hydrometallurgy* 184 (2019) 140-150 (Queen's University, Kingston, Canada) relates to oxidative precipitation of cerium in acidic chloride solutions using hydrogen peroxide, sodium hypochlorite, potassium permanganate and Caro's Acid.

DD65075 (Albert Krause, Heinz Schade, Dr. Herfried Richter, 1969) relates to a method for obtaining rare earths contained in rock phosphates in the form of rare earth phosphates as a byproduct in the manufacture of certain multi-nutrient fertilizers, wherein a potassium permanganate solution is used.

There remains a need for separating thorium and cerium from other rare earths metals in a phosphate rare earths concentrate made from apatite, in order to produce a rare earth concentrate that can be safely handled and from which rare earths can be easily separated from each other.

SUMMARY

According to one aspect of the disclosure, a method is disclosed for separating thorium and cerium from a solid concentrate comprising compounds of thorium, cerium and one or more further rare earth metals, said solid concentrate obtainable by neutralizing to pH 1.8 the pH of an aqueous composition comprising from 6 to 21 weight % nitric acid, from 25 to 33 weight % phosphoric acid, from 3.5 to 5 weight % calcium, and amounts of compounds of thorium, cerium and one or more further rare earth metals, the weight % being relative to the total weight of the aqueous composition, and subsequently precipitating and separating the solid concentrate comprising the compounds of thorium and cerium, comprising the steps of:

a) contacting the solid concentrate with an acid such as to achieve a composition with a pH of less than 0.5;
b) reacting the acid composition obtained in step a) with ozone or heating the acid composition obtained in step a) at a temperature ranging from 110° C. to 130° C. for a time period ranging from 1 to 3 hours, thereby oxidizing the cerium ions in the acid composition to an oxidation state of +IV;
c) increasing, to at most 2, such as between pH 1 and 2, the pH of the composition obtained in step b), such as between pH 1 and 2, resulting in the precipitation of thorium and cerium compounds; and
d) separating the precipitated thorium and cerium compounds from the composition obtained in step c) to obtain an aqueous acidic rare earth solution depleted in thorium and cerium.

The inventors have found that, by using the method of the disclosure, cerium and thorium can be selectively and simultaneously separated from other rare earths present in a solid rare earth concentrate, obtainable by neutralizing to pH 1.8 an aqueous composition comprising from 6 to 21 weight % nitric acid, from 25 to 33 weight % phosphoric acid, from 3.5 to 5 weight % calcium, the weight % being relative to the total weight of the aqueous composition, and amounts of compounds of thorium, cerium and one or more further rare earth metals. Such a concentrate is obtainable in the nitrophosphate process to produce nitrogen fertilizers. The method yields an acidic rare earths solution depleted in both radioactive thorium, hence safe to handle, and in cerium, which allows subsequent optimal separation of the rare earths in the acidic solution. For clarity, it is specified that the group of one or more further rare earth metals, as referred to above, does not comprise cerium.

According to one aspect of the disclosure, a method is disclosed for separating thorium and cerium from a solid concentrate comprising compounds of thorium, cerium and one or more further rare earth metals. The method comprises the steps of neutralizing to pH 1.8 the pH of an aqueous composition comprising from 6 to 21 weight % nitric acid, from 25 to 33 weight % phosphoric acid, from 3.5 to 5 weight % calcium, and amounts of compounds of thorium, cerium and one or more further rare earth metals, the weight % being relative to the total weight of the aqueous composition, and subsequently precipitating and separating the solid concentrate comprising the compounds of thorium and cerium. The method further comprises the steps of:

a) contacting the solid concentrate with an acid such as to achieve a composition with a pH of less than 0.5;
b) reacting the acid composition obtained in step a) with ozone or heating the acid composition obtained in step a) at a temperature ranging from 110° C. to 130° C. for a time period ranging from 1 to 3 hours, thereby oxidizing the cerium ions in the acid composition to an oxidation state of +IV;
c) increasing, to at most 2, such as between 1 and 2, the pH of the composition obtained in step b), resulting in the precipitation of thorium and cerium compounds; and
d) separating the precipitated thorium and cerium compounds from the composition obtained in step c) to obtain an aqueous acidic rare earth solution depleted in thorium and cerium.

According to one embodiment of any of the methods of the disclosure, step a) consists of contacting the solid concentrate, with an acid such as to achieve a suspension with a pH of less than 0.5, with the aim of digesting the solid concentrate.

According to one embodiment of any of the methods of the disclosure, the method further comprises the steps of:

a') contacting with an acid the precipitated thorium and cerium compounds obtained in step d) such as to achieve a composition with a pH of less than 0.5;
b') reacting the acid composition obtained in step a') with ozone or heating the acid composition obtained in step a') at a temperature ranging from 110° C. to 130° C. for a time period ranging from 1 to 3 hours, thereby oxidizing the cerium ions in the acid composition to an oxidation state of +IV;
c') increasing, to at most 2, such as between pH 1 and 2, the pH of the composition obtained in step b'), resulting in the precipitation of thorium and cerium compounds; and
d') separating the precipitated thorium and cerium compounds from the composition obtained in step c') to obtain an aqueous acidic rare earth solution depleted in thorium and cerium.

According to one embodiment of any of the methods of the disclosure, the method further comprises the steps of:

b") reacting the acid solution obtained in step d) with ozone or heating the acid solution obtained in step d) at a temperature ranging from 110° C. to 130° C. for a time period ranging from 1 to 3 hours, thereby oxidizing the cerium ions in the acid composition to an oxidation state of +IV;
c") increasing, to at most 2, such as between pH 1 and 2, the pH of the solution obtained in step b"), resulting in the precipitation of thorium and cerium compounds; and
d") separating the precipitated thorium and cerium compounds from the composition obtained in step c") to obtain an aqueous acidic rare earth solution depleted in thorium and cerium.

According to one embodiment of any of the methods of the disclosure, the acid used in steps a) and a') is from 90 to 98 weight % sulphuric acid (i.e. sulphuric acid with a concentration of from 90 to 98 weight %), from 70 to 72 weight % perchloric acid (i.e. perchloric acid with a concentration of from 70 to 72 weight %) or from 55 to 65 weight % nitric acid (i.e. nitric acid with a concentration of from 55 to 65 weight %).

According to one embodiment of any of the methods of the disclosure, the acid used in steps a) and a') is from 55 to 65 weight % nitric acid.

According to one embodiment of the method of the disclosure, steps b), b') and b") are performed by heating the acid compositions obtained in steps a) and a') or the acid solution obtained in step d) at a temperature ranging from 110° C. to 130° C. for a time period ranging from 1 to 3 hours.

According to one embodiment of any of the methods of the disclosure, the oxidizing agent in steps b), b') and b") is ozone.

According to one embodiment of any of the methods of the disclosure, the pH in steps c), c') and c") is increased to a value ranging from 1.1 to 1.4.

According to one embodiment of any of the methods of the disclosure, the aqueous composition from which the solid concentrate is obtainable, comprises from 0.001 to 0.01 weight % of thorium, from 0.1 to 0.3 weight % of cerium, and from 0.1 to 0.7 weight % of further rare earth metals, the weight % being relative to the weight of the aqueous composition.

According to one embodiment of any of the methods of the disclosure, the aqueous composition from which the solid concentrate is obtainable, comprises from 7 to 8 weight % nitric acid, from 25 to 33 weight % phosphoric acid, from 3.5 to 5 weight % calcium, from 0.001 to 0.002 weight % of thorium, from 0.15 to 0.25 weight % of cerium, and from 0.25 to 0.65 weight % of further rare earth metals, the weight % being relative to the weight of the aqueous composition.

According to one embodiment of any of the methods of the disclosure, the aqueous composition from which the solid concentrate is obtainable, comprises from 6.5 to 8 weight % nitric acid, from 26 to 31 weight % phosphoric acid, from 3.5 to 4.5 weight % calcium, from 0.006 to 0.009 weight % of thorium, from 0.14 to 0.2 weight % of cerium and from 0.2 to 0.56 weight % of further rare earth metals, the weight % being relative to the weight of the aqueous composition According to one embodiment of the method of the disclosure, the aqueous composition from which the solid concentrate is obtainable, comprises 3.5±0.5 weight % calcium, the weight % being relative to the total weight of the aqueous composition.

According to one embodiment of any of the methods of the disclosure, the method further comprises the steps of:

e) contacting the solid concentrate with water; and f) separating the water from the solid concentrate;

wherein steps e) and f) are performed prior to steps a) and a').

According to one embodiment of any of the methods of the disclosure, the aqueous composition from which the solid concentrate is obtainable, is obtained by the steps of:

digesting an amount of phosphate rock in nitric acid at about 65° C. to obtain a digest; followed by removing calcium nitrate from the digest.

According to one embodiment of any of the methods of the disclosure, the aqueous composition from which the solid concentrate is obtainable, is obtained by:

digesting an amount of phosphate rock in nitric acid at about 65° C. to obtain a digest; followed by removing calcium nitrate from the digest;

and steps c), c') and c") are performed using ammonia, preferably gaseous ammonia.

According to one embodiment of any of the methods of the disclosure, the thorium and cerium compounds precipitated in step d) are recycled to a liquor of the nitrophosphate process comprising from 18 to 21 weight % nitric acid, from 25 to 29 weight % phosphoric acid and from 4 to 5 weight % calcium, and neutralized to pH 5.8, the weight % being relative to the total weight of the liquor.

According to another aspect of the disclosure, an aqueous acidic rare earth solution comprising from 1 to 5 weight % rare earths, from 17 to 35 weight % nitric acid, from 3 to 8 weight % phosphoric acid, from 0.5 to 2.5 weight % calcium, less than 5000 ppm by weight cerium, less than 100 ppm by weight thorium, and about 0.1 g/l manganese, is disclosed.

According to one aspect of the disclosure, a composition enriched in cerium and thorium compounds comprising from 4 to 6 weight % calcium, from 4 to 7 weight % phosphorous, from 10 to 17 weight % cerium, from 5 to 10 weight % other rare earths and from 0.5 to 1 weight % thorium.

DETAILED DESCRIPTION

Throughout the description and claims of this specification, the words "comprise" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the disclosure are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The disclosure is not restricted to the details of any foregoing embodiments. The disclosure extends to any novel one, or any novel combination, of the features disclosed in this specification (including any accompanying claims, abstract and drawings), or to any novel one, or any novel combination, of the steps of any method or process so disclosed.

The enumeration of numeric values by means of ranges of figures comprises all values and fractions in these ranges, as well as the cited end points. The terms "from . . . to . . . " and "ranges from . . . to . . . " as used when referring to a range for a measurable value, such as a parameter, an amount, a time period, and the like, is intended to include the limits associated to the range that is disclosed.

Throughout this application, the term "about" is used to indicate that a value includes the standard deviation of error for the device or method being employed to determine the value.

All references cited in this description are hereby deemed to be incorporated in their entirety by way of reference.

The pH values in this application, unless otherwise stated, are the values measured from a sample prepared by subsequently sampling a composition for which a pH value is to be determined, weighing the amount of sampled composition, adding to the sampled composition 13 grams of water per gram of sampled composition and mixing the added water and the sampled composition so as to make a homogenous sample.

In general, it has been discovered that thorium and cerium can be separated from a solid composition comprising thorium, cerium and further rare earth metals, particular in concentrated form, by a (partial) dissolution of the solid concentrate at pH of less than 0.5 and oxidation of the cerium ions to an oxidation state of +IV; followed by precipitation of thorium and cerium compounds by raising the pH to at most pH 2 and separating the precipitated thorium and cerium compounds, thus obtaining a aqueous acidic rare earth solution depleted in thorium and cerium.

According to one aspect of the disclosure, a method is disclosed for separating thorium and cerium from a solid concentrate comprising compounds of thorium, cerium and one or more further rare earth metals, obtainable by neutralizing to pH 1.8 an aqueous composition comprising from 6 to 21 weight % nitric acid, from 25 to 33 weight % phosphoric acid, from 3.5 to 5 weight % calcium, and amounts of compounds of thorium, cerium and one or more further rare earth metals, the weight % being relative to the total weight of the aqueous composition, and subsequently precipitating and separating the compounds of thorium and cerium, comprising the steps of:

a) contacting the solid concentrate with an acid such as to achieve a suspension with a pH of less than 0.5;
b) reacting the acid composition obtained in step a) with an oxidizing agent, in particular ozone, or heating the acid composition obtained in step a) at a temperature ranging from 110° C. to 130° C. for a time period ranging from 1 to 3 hours, thereby oxidizing the cerium ions in the acid composition obtained in step a) to an oxidation state of +IV;
c) increasing, to at most 2, such as between 1 and 2, the pH of the composition obtained in step b), resulting in the precipitation of thorium and cerium compounds; and
d) separating the precipitated thorium and cerium compounds from the composition obtained in step c) to obtain an aqueous acidic rare earth solution depleted in thorium and cerium.

The pH in step c) can be increased to the final pH value in a single step or stepwise. When the pH is increased stepwise, a precipitate then is collected in step d) following each pH increasing step c), until the final pH is reached. All precipitates obtained in step d) can then be combined or be subject to further treatment individually.

The solid concentrate is obtainable, for example, from the nitrophosphate process. The nitrophosphate process comprises six main steps. In a first step (digestion step), phosphate rock is digested in nitric acid yielding a digestion liquor at a temperature of 65° C. In a second step (crystallization step), calcium nitrate tetrahydrate is crystallized out of the digestion liquor yielding a crystal slurry. In a third step (separation step), the crystallized calcium nitrate is separated by a technique such as filtration or centrifugation, resulting in calcium nitrate tetrahydrate crystals being separated from the liquid of the crystal slurry, referred to as the mother liquor. In a fourth step (neutralisation step), the mother liquor is neutralized using ammonia up to a pH of approximately 5.8. In a fifth step (particulation), the neutralized mother liquor is particulated into the final product (e.g. for use as an NP-fertilizer). Potassium salts can be added during the neutralization process or to the neutralized mother liquor. When the particulation is performed by prilling, an evaporation step is performed upfront the addition of potassium salts, in order to reach a water content sufficiently low to perform prilling. In a sixth step (coating step), the particles can be subsequently coated, for example with a coating agent suitable for reducing moisture absorption and for, thereby, ensuring proper physical properties for the particles.

By neutralizing the mother liquor to an intermediate pH value of 1.8, prior to achieving full neutralization to pH 5.8, a solid concentrate can be precipitated and separated from the partially neutralized mother liquor by filtration. The mother liquor may then be fully neutralized to pH 5.8. For example, the solid concentrate obtained by precipitation from the mother liquor at pH 1.8 may comprise from 9 to 11 weight % elemental phosphate, from 4 to 5 weight % calcium, from 5 to 8 weight % cerium thorium, 100 to 300 ppm cerium and from 10 to 16 weight % total rare earth metal compounds, the weight % being relative to the total weight of the solid concentrate.

It is preferred to not use hydrogen peroxide as an oxidizing agent: under acidic conditions, hydrogen peroxide may act as reducing agent rather than an oxidizing agent. It is also not preferred to use potassium permanganate as an oxidizing agent. The method of the disclosure enables to deplete the solid concentrate mentioned above in thorium such that the ratio of the weight percentage of thorium over the weight percentage of non-cerium rare earths in the aqueous composition, from which the solid concentrate is prepared, is reduced by 94 to 99% in the acidic solution obtained in step d). The ratio of the weight percentage of cerium over the weight percentage of non-cerium rare earths in the aqueous composition, from which the solid concentrate is prepared, is reduced by 91 to 96% in the acidic solution obtained in step d).

Surprisingly, the inventors have found that, by performing the method of the present disclosure, it is possible to simultaneously precipitate thorium and cerium from a solution comprising thorium, cerium and one or more further rare earth metals. Thus, by using the method according to the disclosure, a rare earth solution is obtained that can be safely handled since it comprises safe levels of thorium. The solution further comprises sufficiently low levels of cerium such that a rare earth concentrate is obtained from which the recovery of the other rare earths than cerium can be maximized.

According to one aspect of the disclosure, a method is disclosed for separating thorium and cerium from a solid concentrate comprising compounds of thorium, cerium and one or more further rare earth metals. The method comprises the steps of neutralizing to pH 1.8 the pH of an aqueous composition comprising from 6 to 21 weight % nitric acid, from 25 to 33 weight % phosphoric acid, from 3.5 to 5 weight % calcium, and amounts of compounds of thorium, cerium and one or more further rare earth metals, the weight % being relative to the total weight of the aqueous composition, and subsequently precipitating and separating the solid concentrate comprising the compounds of thorium and cerium. The method further comprises the steps of:

a) contacting the solid concentrate with an acid such as to achieve a composition with a pH of less than 0.5;

b) reacting the acid composition obtained in step a) with an oxidizing agent, in particular ozone, or heating the acid composition obtained in step a) at a temperature ranging from 110° C. to 130° C. for a time period ranging from 1 to 3 hours, thereby oxidizing the cerium ions in the acid composition obtained in step a) to an oxidation state of +IV;

c) increasing, to at most 2, such as between 1 and 2, the pH of the composition obtained in step b), resulting in the precipitation of thorium and cerium compounds; and d) separating the precipitated thorium and cerium compounds from the composition obtained in step c) to obtain an aqueous acidic rare earth solution depleted in thorium and cerium.

It is preferred to not use hydrogen peroxide as an oxidizing agent: under acidic conditions, hydrogen peroxide may act as reducing agent rather than an oxidizing agent. It is also not preferred to use potassium permanganate as an oxidizing agent.

According to one embodiment of any the methods of the disclosure, step a) consists of contacting the solid concentrate, with an acid such as to achieve a suspension with a pH of less than 0.5, with the aim of digesting the solid concentrate. In particular, the acid used in step a) is from 60 to 65 weight % nitric acid. In particular, 1 ml of 55 weight % nitric acid is used per g of concentrate to be digested. The digestion may be partial or full. In a particular embodiment, the digestion is performed partially and, consequently, some solids remain present, which results in the obtention of a suspension in step a).

According to one embodiment of any the methods of the disclosure, the method further comprises the steps of:

a') contacting with an acid the precipitated thorium and cerium compounds obtained in step d) such as to achieve a composition with a pH of less than 0.5;

b') reacting the acid composition obtained in step a') with an oxidizing agent, in particular ozone, or heating the acid composition obtained in step a') at a temperature ranging from 110° C. to 130° C. for a time period ranging from 1 to 3 hours, thereby oxidizing the cerium ions in the acid composition to an oxidation state of +IV;

c') increasing, to at most 2, such as between 1 and 2, the pH of the composition obtained in step b'), resulting in the precipitation of thorium and cerium compounds; and d') separating the precipitated thorium and cerium compounds from the composition obtained in step c') to obtain an aqueous acidic rare earth solution depleted in thorium and cerium.

The pH in step c') can be increased to the final pH value in a single step or stepwise. When the pH is increased stepwise, a precipitate then is collected in step d') following each pH increasing step c), until the final pH is reached. In certain embodiments, all precipitates obtained in step d') are combined.

It is preferred to not use hydrogen peroxide as an oxidizing agent: under acidic conditions, hydrogen peroxide may act as reducing agent rather than an oxidizing agent. It is also not preferred to use potassium permanganate as an oxidizing agent.

The amount of rare earth metals recovered is optimized by performing, starting with the precipitated thorium and cerium compounds obtained in step d), the series of steps a') to d'). The steps a'), b'), c') and d') respectively correspond to the steps a), b), c) and d) performed starting with the solid concentrate used in step a). Repeating the series of steps a') to d'), starting with the precipitated thorium and cerium compounds obtained in steps d'), will further increase the recovery of rare earth metals.

According to one embodiment of any the methods of the disclosure, the method further comprises the steps of:

b") reacting the acid solution obtained in step d) with on oxidizing agent, in particular ozone, or heating the acid solution obtained in step d) at a temperature ranging from 110° C. to 130° C. for a time period ranging from 1 to 3 hours, thereby oxidizing the cerium ions in the acid composition obtained in step d) to an oxidation state of +IV;

c") increasing, to at most 2, such as between 1 and 2, the pH of the solution obtained in step b"), resulting in the precipitation of thorium and cerium compounds; and d") separating the precipitated thorium and cerium compounds from the composition obtained in step c") to obtain an aqueous acidic rare earth solution depleted in thorium and cerium.

The pH in step c") can be increased to the final pH value in a single step or stepwise. When the pH is increased stepwise, a precipitate then is collected in step d") following each pH increasing step c), until the final pH is reached. In certain embodiments, all precipitates obtained in step d") are then combined.

It is preferred to not use hydrogen peroxide as an oxidizing agent: under acidic conditions, hydrogen peroxide may act as reducing agent rather than an oxidizing agent. It is also not preferred to use potassium permanganate as an oxidizing agent.

The series of steps b") to d") optimizes the amounts of precipitated thorium and cerium compounds, hence the extent to which the acidic solution obtained in step d) is free of cerium and thorium. The optimization of the precipitation of those cerium and thorium compounds is achieved by performing, on the acid solution obtained in step d) the steps b") to d"), b") and d") or c") and d"). The steps b"), c") and d") respectively correspond to the steps b), c) and d) performed starting with the solid concentrate used in step a).

Indeed, oxidizing to a +IV state any cerium ion in the acidic solution obtained in step d) not in such oxidation state, increasing the pH of the acidic solution obtained in step d), as well as a combination of such oxidizing and increasing of the pH steps, result in the precipitation of cerium and thorium compounds not precipitated in step c). Repeating the steps b") to d"), b") and d") or c") and d"), starting with the acidic solution obtained in steps d"), will further improve the removal of cerium and thorium compounds from the acidic solution.

According to one embodiment of any the methods of the disclosure, the steps a) and a') are performed using from 90 to 98 weight % sulphuric acid, from 70 to 72 weight % perchloric acid or from 55 to 65 weight % nitric acid. Such acid solutions are sufficiently strong for digesting the solid concentrate. In addition, such acid solutions have oxidizing potential that can at least partially assist in performing step b).

According to one embodiment of any the methods of the disclosure, the acid used in steps a) and a') is from 60 to 65 weight % nitric acid. By using such acid solutions, it is possible to recycle the precipitated and filtered thorium and cerium compounds, bearing traces of the nitric acid solution, to processes comprising nitric acid, such as the nitrophosphate process described above and from which the solid concentrate is obtainable. The recycling of the precipitated thorium and cerium compounds results in those elements being diluted to acceptable, safe limits.

According to one embodiment of any the methods of the disclosure, steps b), b') and b") are preferably performed by heating the acid compositions obtained in step a) and a') or the acid solution obtained in step d) at a temperature ranging from 110° C. to 130° C. for a time period ranging from 1 to 3 hours. By heating the acid compositions within this temperature range and within this time period, oxidation of the cerium ions to an oxidation state of +IV takes place and the acid used for digestion of the solid concentrate can act as the oxidizing agent, without introduction of an additional chemical as the oxidizing agent. Furthermore, as the oxidation of cerium ions to an oxidation state of +IV is kinetically slow at ambient temperature, heating of the acid solution assists in having the oxidation reaction proceed at an acceptable speed. In addition, it is known that the solubility of cerium phosphate compounds decreases with increasing temperature. By heating the acid solution at a temperature within this temperature range and within this time period, the precipitation potential of the oxidized cerium compounds is increased and optimized: the rare earth metal compounds, other than oxidized cerium compounds, preserve higher solubility in acid than thorium and oxidized cerium compounds, enabling the selective precipitation of cerium and thorium compounds in steps c), c') and c"). As defined herein, by selective precipitation and/or selectivity, it is meant that the ratio of the weight percentage of thorium over the weight percentage of non-cerium rare earths in the aqueous composition is reduced by 94 to 99% in the acidic solution obtained in step d), and that the ratio of the weight percentage of cerium over the weight percentage of non-cerium rare earths in the aqueous composition is reduced by 91 to 96% in the acidic solution obtained in step d). The person skilled in the art will understand that the heating time can be further optimised according to the content of the aqueous composition such as from 1 hour to 6 hours, or from one 1 hour to 8 hours, or from 1 hour to 10 hours such as to optimise the amount of cerium that is oxidised.

According to one embodiment of any the methods of the disclosure, the oxidizing agent in steps b), b') and b") is ozone. It is preferred to not use hydrogen peroxide as an oxidizing agent: under acidic conditions, hydrogen peroxide may act as reducing agent rather than an oxidizing agent. It is also not preferred to use potassium permanganate as an oxidizing agent. Furthermore, the use of ozone as the oxidizing agent enables an adjustment of the pH in step c) to about 1, hence at a lower value than when other oxidizing agents are used. The use of ozone therefore results in optimal selectivity in the precipitation of cerium and thorium compounds. This results in a higher yield, such as 80-90% yield, of the rare earth metals in the aqueous acidic rare earths solution obtained in steps d), d') and d"). As defined herein, the yield of an element is the ratio of the amount of the element in the nitric acid solution obtained in step d), d') and d") over the amount of the element in the rare earth concentrate digested in step a) and a') respectively.

According to one embodiment of any the methods of the disclosure, the pH in steps c), c') and c") is increased to a value ranging from 1.1 to 1.4. Within this pH range, the precipitation of the thorium and cerium compounds is increased, while the rare earth metal compounds other than cerium compounds preserve higher solubility in nitric acid than thorium and cerium compounds, enabling the selective precipitation of cerium and thorium compounds in steps c), c') and c") The method of the disclosure also results in iron and aluminium metal compounds being separated together with the thorium and cerium compounds. As a result, the weight and volume of the rare earth concentrate obtained following the precipitation and the separation of the precipitated elements are reduced. Therefore, the subsequent processing of the acid solution obtained in steps d), d') and d") is facilitated.

According to one embodiment of any the methods of the disclosure, the separating in step d) is done by filtering.

According to one embodiment of any the methods of the disclosure, the aqueous composition from which the solid concentrate is obtainable, comprises from 0.001 to 0.01 weight % of thorium, from 0.1 to 0.3 weight % of cerium, and from 0.1 to 0.7 weight % further rare earth metals, the weight % being relative to the total weight of the aqueous composition. As defined herein, further rare earth metals means one or more non-cerium rare earth metals.

According to one embodiment of any the methods of the disclosure, the aqueous composition from which the solid concentrate is obtainable, comprises from 0.001 to 0.009 weight % of thorium, the weight % being relative to the total weight of the aqueous composition.

According to one embodiment of any the methods of the disclosure, the aqueous composition from which the solid concentrate is obtainable, comprises from 7 to 8 weight % nitric acid, from 25 to 33 weight % phosphoric acid, from 3.5 to 5 weight % calcium, from 0.001 to 0.002 weight % of thorium, from 0.15 to 0.25 weight % of cerium, and from 0.25 to 0.65 weight % of further rare earth metals, the weight % being relative to the total weight of the aqueous composition. This aqueous composition corresponds to a nitrophosphate mother liquor produced using Kola phosphate rock as a raw material (originating from deposits in the Kola Peninsula, Russia).

According to one embodiment of any the methods of the disclosure, the aqueous composition from which the solid concentrate is obtainable, comprises from 6.5 to 8 weight % nitric acid, from 26 to 31 weight % phosphoric acid, from 3.5 to 4.5 weight % calcium, from 0.006 to 0.009 weight % of thorium, from 0.14 to 0.2 weight % of cerium and from 0.2 to 0.56 weight % of further rare earth metals, the weight % being relative to the total weight of the aqueous composition. This aqueous composition corresponds to a nitrophosphate mother liquor produced using the Palfos phosphate rock as a raw material (originating from deposits in South Africa—see e.g. Phosphate in South Africa, E. H. Roux et al., J. S. Afr. Inst. Min. Metall., Vol 89, no. 5, May 1989, pp. 129-139).

According to one embodiment of any the methods of the disclosure, the aqueous composition from which the solid concentrate is obtainable, comprises 3.5±0.5 weight % calcium, the weight % being relative to the total weight of the aqueous composition. At this low calcium concentration, upon increasing the pH in steps c), c') and c"), the precipitation of thorium and cerium compounds will be maximized as the competing precipitation of calcium phosphates will be minimized.

According to one embodiment of any the methods of the disclosure, the method further comprising the steps of:

e) contacting the solid concentrate with water; and f) separating the water from the solid concentrate;

wherein steps e) and f) are performed prior to steps a) and a'). By introducing those additional method steps, the solid concentrate is less viscous and can be more easily handled to proceed to the steps a) and a') of the method of the disclosure. In addition, steps e) and f) result in the removal of water-soluble impurities from the solid concentrate which results in an optimal, selective precipitation of cerium and thorium compounds in steps c), c') and c").

According to one embodiment of any the methods of the disclosure, the aqueous composition from which the solid concentrate is obtainable, is obtained by the steps of:

digesting an amount of phosphate rock in nitric acid at about 65° C. to obtain a digest; followed by removing calcium nitrate from the digest.

In other words, the aqueous composition from which the solid concentrate is obtainable, is a nitrophosphate mother liquor. As described above, the use of such a mother liquor is particularly suitable for producing a solid concentrate, rich in rare earth metals when phosphate rock raw materials, rich in those rare earth metals, are used to produce the nitrophosphate mother liquor. Igneous phosphate rocks comprising more than 0.4 weight % of rare earth metals are particularly suitable for producing a solid concentrate.

Furthermore, using the nitrophosphate process as the precursor of the solid concentrate opens for the possibility to, as also described above, recycle thorium and cerium compounds after their separation in step d) of the method of the disclosure.

Any agent suitable for increasing the pH or, in other words, any conventional chemical base such as, but non-limited to, sodium hydroxide, potassium hydroxide or ammonium hydroxide can be used for increasing the pH in steps c), c') and c"). However, according to an embodiment of the method of the disclosure, the increase of the pH in steps c), c') and c") is performed using gaseous ammonia. By using gaseous ammonia in step c), c') and c"), no chemical is introduced in the process that is not compatible with the nitrophosphate process. As mentioned above, this is particularly suitable in view of recycling the precipitated thorium and cerium compounds to the nitrophosphate process. In addition, the use of ammonia provides the advantage of minimizing the amount of water used in the process and results in energy savings.

According to one embodiment of any the methods of the disclosure, ammonia is used in steps c), c') and c") of the method of the disclosure which, as described above, results in the precipitation of phosphate compounds of thorium and cerium. As a measure to minimize the phosphate losses from the process, those phosphate compounds may then be returned to a mother liquor of the nitrophosphate, comprising from 18 to 21 weight % nitric acid, from 25 to 29 weight % phosphoric acid and from 4 to 5 weight % calcium, and neutralized to pH 5.8, the weight % being relative to the total weight of the mother liquor. By returning cerium and thorium to the mother liquor neutralized to pH 5.8, it is ensured that the mother liquor neutralized to a pH of 1.8 does not saturate in thorium and cerium compounds, which would require the removal of additional cerium and thorium compounds according to the method of the disclosure and possibly disturb the selective precipitation of thorium and cerium compounds in step c). This disturbance may, in turn, result in an acidic solution in step d) with a low degree of purity, that is not optimally depleted in thorium and cerium, and/or a low yield of rare earth metals.

In particular, prior to being recycling to the mother liquor of the nitrophosphate neutralized to pH 5.8, the cerium and thorium compounds separated in steps d), d') and d") may be subjected to chemical reduction in order for cerium to be reduced to an oxidation state of +III. By performing such reduction, the thorium and cerium compounds separated in step d), and that will be part of the fertilizer particles produced by the nitrophosphate process, will have solubility properties such that that the phosphate in those compounds will be accessible to plants or crops, upon distribution of the fertilizer on the soil and subsequent irrigation of this soil, from which the plants or crops are to be grown.

According to one aspect of the disclosure, an aqueous acidic rare earth solution comprising from 1 to 5 weight % rare earths, from 17 to 35 weight % nitric acid, from 3 to 8 weight % phosphoric acid, from 0.5 to 2.5 weight % calcium, less than 5000 ppm by weight cerium, less than 100 ppm by weight thorium, between 0 and 0.1 g/l manganese. Preferably, the aqueous rare earth solution from 300 ppm to 4000 ppm by weight cerium, or from 300 ppm to 3000 ppm by weight cerium, or from 300 ppm to 1000 ppm by weight cerium. Preferably, the aqueous rare earth solution comprises from 0.1 ppm to 100 ppm by weight thorium, such as from 1 ppm by weight to 50 ppm by weight thorium, or from 0.8 ppm by weight to 10 ppm by weight thorium.

According to one aspect of the disclosure, a composition enriched in cerium and thorium compounds comprising from 4 to 6 weight % calcium, from 4 to 7 weight % phosphorous, from 10 to 17 weight % cerium, from 5 to 10 weight % other rare earths and from 0.5 to 1 weight % thorium.

Experimental

An experiment was run in 2 stages:

Stage 1: Preparation of a solid concentrate comprising compounds of thorium, cerium and one or more further rare earth metals. A neutralized Kola mother liquor was prepared according to the nitrophosphate process by digesting Kola phosphate rock in 58-64 weight % nitric acid;

subsequently cooling down the resulting digestion liquor to a temperature of 0-4° C., thereby precipitating calcium nitrate tetrahydrate;

subsequently separating the precipitated calcium nitrate to yield a mother liquor by filtering, and finally, neutralizing the mother liquor to a pH 1.8.

The resulting neutralized Kola mother liquor was partly neutralized with ammonia to pH 1.8, measured after diluting a sample with water by a weight factor of 13. A temperature of about 120° C. (boiling) was reached during the neutralization. The so-called neutralized solution (at pH 1.8) was then held at boiling temperature for 3 hours to facilitate the precipitation of cerium and thorium compounds. The liquid fraction was further treated in the nitrophosphate process for neutralization to pH 5.8, measured after diluting a sample with water by a weight factor of 13. The solid fraction was washed in water and separated again to produce a solid concentrate comprising from 9 to 11 weight % elemental phosphate, from 4 to 5 weight % calcium, from 5 to 8 weight % cerium thorium, 100 to 300 ppm cerium and from 10 to 16 weight % total rare earth metal compounds, the weight % being relative to the total weight of the solid concentrate.

Stage 2: Separation of Cerium and Thorium From the Rare Earths in the Solid Concentrate.

The rare earths concentrate was digested during a time period of one hour in 55 weight % nitric acid, at an initial concentration of 1 ml of acid per g of the rare earths concentrate and at a temperature of about 120° C. The digested liquor was then neutralized with water and ammonia to pH 1.2, measured after diluting a sample with water by a weight factor of 13. This resulted in the precipitation of the cerium ions in a +IV oxidation state and in the tetravalent thorium ions as phosphate complexes. The solution was then separated from the precipitated solids by filtration. The filtered liquid fraction comprised 80 weight % of the rare earths other than cerium and initially present in the rare earths concentrate, about 5 weight % of the cerium initially present in the rare earths concentrate, and no thorium. The solid fraction comprised cerium and thorium phosphate compounds. This solid fraction then was reintroduced in the nitrophosphate process, in the mother liquor neutralized to pH 5.8.

The invention claimed is:

1. A method for separating thorium and cerium from a solid concentrate comprising compounds of thorium, cerium and one or more further rare earth metals, obtained by increasing to pH 1.8 the pH of an aqueous composition comprising from 6 to 21 weight % nitric acid, from 25 to 33 weight % phosphoric acid, from 3.5 to 5 weight % calcium, amounts of compounds of thorium, cerium and one or more further rare earth metals, the weight % being relative to the total weight of the aqueous composition, and subsequently precipitating and separating the solid concentrate comprising the compounds of thorium and cerium, the method comprising the steps of:

a) contacting the solid concentrate with an acid to achieve an acid composition comprising cerium ions with a pH of less than 0.5;

b) reacting the acid composition obtained in step a) with ozone or heating the acid composition obtained in step a) at a temperature ranging from 110° C. to 130° C. for a time period ranging from 1 to 3 hours, thereby oxidizing the cerium ions in the acid composition to an oxidation state of +IV;

c) increasing, to at most 2, the pH of the composition obtained in step b), resulting in the precipitation of thorium and cerium compounds; and d) separating the precipitated thorium and cerium compounds from the composition obtained in step c) to obtain an aqueous acidic rare earth solution depleted in thorium and cerium.

2. A method for separating thorium and cerium from a solid concentrate comprising compounds of thorium, cerium and one or more further rare earth metals, comprising the steps of increasing to pH 1.8 the pH of an aqueous composition comprising from 6 to 21 weight % nitric acid, from 25 to 33 weight % phosphoric acid, from 3.5 to 5 weight % calcium, and amounts of compounds of thorium, cerium and one or more further rare earth metals, the weight % being relative to the total weight of the aqueous composition, and subsequently precipitating and separating the solid concentrate comprising the compounds of thorium and cerium, further comprising the steps of:

a) contacting the solid concentrate with an acid to achieve an acid composition comprising cerium ions with a pH of less than 0.5;

b) reacting the acid composition obtained in step a) with ozone or heating the acid composition obtained in step a) at a temperature ranging from 110° C. to 130° C. for a time period ranging from 1 to 3 hours, thereby oxidizing the cerium ions in the acid composition to an oxidation state of +IV;

c) increasing, to at most 2, the pH of the composition obtained in step b), resulting in the precipitation of thorium and cerium compounds; and d) separating the precipitated thorium and cerium compounds from the composition obtained in step c) to obtain an aqueous acidic rare earth solution depleted in thorium and cerium.

3. The method according to claim 1, wherein step a) consists of contacting the solid concentrate, with an acid to achieve a suspension with a pH of less than 0.5, to digest the solid concentrate.

4. The method according to claim 1, further comprising the steps of:

a') contacting with an acid the precipitated thorium and cerium compounds obtained in step d) to achieve a composition with a pH of less than 0.5;

b') reacting the acid composition obtained in step a') with ozone or heating the acid composition obtained in step a') at a temperature ranging from 110° C. to 130° C. for a time period ranging from 1 to 3 hours, thereby oxidizing the cerium ions in the acid composition to an oxidation state of +IV;

c') increasing, to at most 2, the pH of the composition obtained in step b'), resulting in the precipitation of thorium and cerium compounds; and d') separating the precipitated thorium and cerium compounds from the composition obtained in step c') to obtain an aqueous acidic rare earth solution depleted in thorium and cerium.

5. The method according to claim 1, further comprising the steps of:

b") reacting the aqueous acidic rare earth solution obtained in step d) with ozone or heating the aqueous acidic rare earth solution obtained in step d) at a temperature ranging from 110° C. to 130° C. for a time period ranging from 1 to 3 hours, thereby oxidizing the cerium ions in the acid composition to an oxidation state of +IV;

c") increasing, to at most 2, the pH of the solution obtained in step b"), resulting in the precipitation of thorium and cerium compounds; and d") separating the precipitated thorium and cerium compounds from the composition obtained in step c") to obtain a second aqueous acidic rare earth solution depleted in thorium and cerium.

6. The method according to claim 1, wherein the acid used in step a) is from 90 to 98 weight % sulphuric acid, from 70 to 72 weight % perchloric acid or from 55 to 65 weight % nitric acid.

7. The method according to claim 6, wherein the acid used in step a) is from 60 to 65 weight % nitric acid.

8. The method according to claim 5, wherein step b) is performed by heating the acid composition obtained in step a) at a temperature ranging from 110° C. to 130° C. for a time period ranging from 1 to 3 hours or wherein step b") is performed by heating the aqueous acidic rare earth solution obtained in step d) at a temperature ranging from 110° C. to 130° C. for a time period ranging from 1 to 3 hours.

9. The method according to claim 1, wherein the acid composition obtained in step a) is reacted with ozone.

10. The method according to claim 1, wherein the pH in step c) is increased to a value ranging from 1.1 to 1.4.

11. The method according to claim 1, wherein the aqueous composition from which the solid concentrate is obtained, comprises from 0.001 to 0.01 weight % of thorium, from 0.1 to 0.3 weight % of cerium, and from 0.1 to 0.7 weight % of further rare earth metals, the weight % being relative to the weight of the aqueous composition.

12. The method according to claim 1, wherein the aqueous composition from which the solid concentrate is obtained, comprises from 7 to 8 weight % nitric acid, from 25 to 33 weight % phosphoric acid, from 3.5 to 5 weight % calcium, from 0.001 to 0.002 weight % of thorium, from 0.15 to 0.25 weight % of cerium, and from 0.25 to 0.65 weight % of further rare earth metals, the weight % being relative to the weight of the aqueous composition.

13. The method according to claim 1, wherein the aqueous composition from which the solid concentrate is obtained, comprises from 6.5 to 8 weight % nitric acid, from 26 to 31 weight % phosphoric acid, from 3.5 to 4.5 weight % calcium, from 0.006 to 0.009 weight % of thorium, from 0.14 to 0.2 weight % of cerium and from 0.2 to 0.56 weight % of further rare earth metals, the weight % being relative to the weight of the aqueous composition.

14. The method according to claim 1, wherein the aqueous composition from which the solid concentrate is obtained, comprises 3.5±0.5 weight % calcium, the weight % being relative to the weight of the aqueous composition.

15. The method of claim 1, further comprising the steps of:

e) contacting the solid concentrate with water; and f) separating the water from the solid concentrate;

wherein steps e) and f) are performed prior to step a).

16. The method of claim 1, wherein the aqueous composition is obtained by the steps of:

digesting an amount of phosphate rock in nitric acid at about 65° C. to obtain a digest; comprising calcium nitrate followed by removing the calcium nitrate from the digest, thereby obtaining the aqueous composition.

17. The method of claim 16, wherein step c) is performed using ammonia.

18. The method of claim 1, wherein the thorium and cerium compounds precipitated in step d) are recycled to a liquor of a nitrophosphate process comprising from 18 to 21 weight % nitric acid, from 25 to 29 weight % phosphoric acid and from 4 to 5 weight % calcium, and neutralized to pH 5.8, the weight % being relative to the weight of the liquor.

19. The method of claim 1 wherein in step c) the pH is increased to between 1 and 2.

20. The method of claim 2 wherein in step c) the pH is increased to between 1 and 2.

21. The method of claim 4 wherein in step c') the pH is increased to between 1 and 2.

22. The method of claim 5 wherein in step c" the pH is increased to between 1 and 2.

23. The method of claim 17 wherein the ammonia is gaseous ammonia.

* * * * *